US006126423A

United States Patent [19]

Freeland

[11] Patent Number: 6,126,423

[45] Date of Patent: Oct. 3, 2000

[54] PRELOADED SPRING MOUNT FOR CRANK PIN/ROTOR BEARING ASSEMBLY

[75] Inventor: Mark Freeland, Farmington Hills, Mich.

[73] Assignee: Ford Global Technologies, Inc., Dearborn, Mich.

[21] Appl. No.: 09/192,109

[22] Filed: Nov. 13, 1998

[51] Int. Cl.[7] ..... F01C 1/02

[52] U.S. Cl. ..... 418/57; 418/55.2; 418/109; 418/1

[58] Field of Search ..... 418/57, 109, 1, 418/55.2

[56] References Cited

U.S. PATENT DOCUMENTS

| | | | |
|---|---|---|---|
| 3,173,406 | 3/1965 | Campos . | |
| 3,767,333 | 10/1973 | Ashilian | 418/56 |
| 4,371,323 | 2/1983 | Fischer et al. . | |
| 5,545,019 | 8/1996 | Beck et al. | 418/55.1 |
| 5,582,513 | 12/1996 | Shigeoka et al. . | |
| 5,681,155 | 10/1997 | Hisanaga et al. | 418/14 |
| 5,755,564 | 5/1998 | Machida et al. | 418/55.2 |

FOREIGN PATENT DOCUMENTS

| | | | |
|---|---|---|---|
| 0086976 | 3/1980 | Japan | 418/57 |
| 02086976 | 3/1990 | Japan | 418/57 |
| 2-86976 | 3/1990 | Japan . | |
| 3-57893 | 3/1991 | Japan . | |
| 03149381 | 6/1991 | Japan | 418/57 |
| 6-185477 | 7/1994 | Japan . | |

*Primary Examiner*—Theresa Trieu

[57] ABSTRACT

Rotary fluid compressor comprises a stator housing and a crankshaft rotatable about an axis of rotation and having a crank pin offset relative to the axis of rotation. A rotor is disposed by a bearing assembly on the crank pin for orbiting motion about the axis of rotation in the stator housing. An annular spring is assembled between the bearing assembly and either the rotor or the crank pin with the spring radially compressed to an extent to provide a controlled spring preload that, in combination with a controlled spring rate, maintains radial sealing force between the rotor and the stator housing between preselected minimum and maximum design values.

11 Claims, 1 Drawing Sheet

PRELOADED SPRING MOUNT FOR CRANK PIN/ROTOR BEARING ASSEMBLY

BACKGROUND OF THE INVENTION

1. Field of the Invention

The present invention relates to a preloaded spring mount for a crank pin/rotor bearing assembly of a rotary fluid compressor.

2. Description of Related Art

Rotary fluid compressors of the type used in vehicle air conditioning systems include a crankshaft having a crank pin that is offset for eccentric motion relative to the axis of rotation of the crankshaft. An orbiting ring or scroll rotor is mounted on the crank pin for translational rotary motion in a stator housing to establish moving line contacts therebetween effective to compress a refrigerant gas inducted into the stator housing. Orbiting ring fluid compressors are described in U.S. Pat. Nos. 5,015,161; 5,240,386; 5,284,426; and 5,472,327. An orbiting scroll fluid compressor is described in U.S. Pat. Nos. 4,365,941.

In the design of such compressors, there is provided a small interference fit between the rotor and the bore of the stator housing to provide a radial fluid sealing force at the moving line contacts where the rotor engages the walls of the stator housing. Upon assembly of the compressor components, there is an inherent rotor/stator housing eccentricity that causes the interference fit to be greater than intended in one quadrant and less than intended in the opposite quadrant of rotor motion. This interference fit thereby produces a problem of very high internal stresses in the rotor and other compressor components that may lead to premature fatigue failure of the rotor in service in the compressor.

Certain orbiting ring/scroll fluid compressors for vehicle air conditioning systems include a pressure switch which is used to decouple the compressor clutch if the output pressure of the compressor reaches a set cutoff limit, such as for example, 350 psi. When the vehicle is driven at low speeds, there is insufficient airflow through the air conditioning system condenser to prevent the output pressure from rising to the cutoff limit. As a result, the compressor will cycle between "on" and "off" states in a manner felt by the vehicle driver as an annoying surging of the vehicle motor.

An object of the present invention is to provide a preloaded spring mount for a crank pin/rotor bearing assembly of a rotary fluid compressor for controlling radial fluid sealing force in a manner that overcomes the aforementioned problems associated with rotary fluid compressors used heretofore.

SUMMARY OF THE INVENTION

The present invention provides a rotary fluid compressor comprising a stator housing and a crankshaft rotatable about an axis of rotation and having a crank pin offset relative to the axis of rotation. A rotor is disposed by a bearing assembly on the crank pin for orbiting motion about the axis of rotation. Annular spring means is disposed between the crank pin and the rotor in circumferential engagement with the bearing assembly. The spring means is compressed (preloaded) to a controlled extent to provide a controlled radial fluid sealing force between the rotor and the stator housing. In effect, the spring means, together with the design interference fit between the rotor/stator housing, provides a preselected minimum design radial sealing force between the rotor and the stator housing. The spring means is provided with a controlled spring rate that limits the radial fluid sealing force so as not to exceed a maximum design radial fluid sealing force when the spring is compressed by the design interference fit between the rotor/housing and the maximum eccentricity therebetween resulting from stack-up tolerances upon assembly of the compressor components.

In accordance with embodiments of the present invention, the spring means includes a circumferentially extending bowed region that provides mechanical spring action under radial load. The spring means is disposed preferably between the bearing assembly and the rotor, or between the bearing assembly and the crank pin.

The above objects, features and advantages of the present invention will become more readily apparent from the following detailed description taken with the following drawings.

BRIEF DESCRIPTION OF THE DRAWINGS

The FIGURE is a sectional view of a crankshaft, bearing assembly, and an orbiting rotor of a rotary fluid compressor with a preloaded spring mount between the bearing assembly and the orbiting rotor pursuant to an embodiment of the present invention.

DETAILED DESCRIPTION OF THE PREFERRED EMBODIMENT

Figure 1:
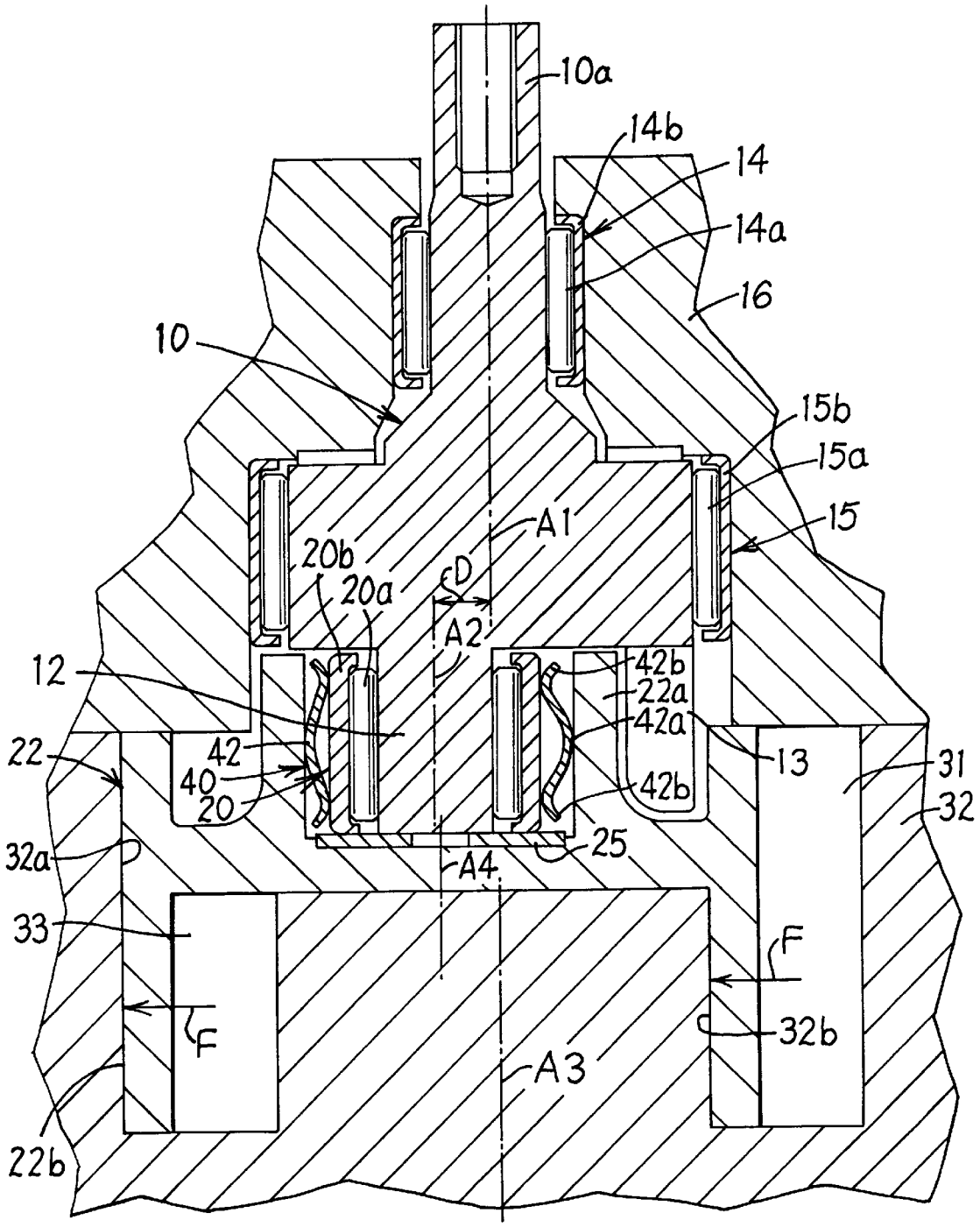

Referring to the FIGURE, a rotary fluid compressor is illustrated having a crankshaft 10 rotatable about an axis of rotation A1. To this end, an internally threaded end 10*a* of the crankshaft is drivingly connected to an electric clutch-controlled pulley (not shown) of a drivebelt of a vehicle air conditioning system in conventional manner. The crankshaft 10 is mounted by bearing assemblies 14 and 15 in compressor housing 16 for rotation about the axis A1. The bearing assemblies 14 and 15 include a plurality of respective needle bearing elements 14*a*, 15*a* and outer races 14*b*, 15*b* with the bearing elements 14*a*, 15*a* riding directly on the crankshaft 10. The crankshaft includes a crank pin 12 which has a centerline axis A2 offset from the axis of rotation A1 by distance D such that the crank pin 12 will rotate eccentrically about axis A1. A conventional counterbalance weight 13 is provided on the crankshaft 10 opposite the crank pin 12.

A bearing assembly 20 is disposed between the crank pin 12 and a cylindrical hollow hub 22*a* of an orbiting rotor 22. The bearing assembly 20 is shown including a plurality of rotatable needle bearing elements 20*a* and outer bearing race 20*b*, the bearing elements 20*a* riding directly on the crank pin 12. The crank pin 12 is confined axially by a thrust washer 25 disposed between the end of the crank pin 12 and a central web or wall of the orbiting rotor 22.

The orbiting rotor 22 is shown in the FIGURE as an orbiting ring rotor that orbits about axis A3 in a stator housing 32. The stator housing 32 includes a first stage stator surface 32*a* and a second stage stator surface 332*b*. In particular, the cylindrical surface 22*b* of the ring rotor 22 rolls relative to the cylindrical stator surfaces 32*a*, 32*b* in a manner forming first and second stage compression chambers 31, 33 as it orbits as described in detail in U.S. Pat. Nos. 5,015,161; 5,240,386; 5,284,426; and 5,472,327, the teachings of which are incorporated herein by reference. Alternately, the orbiting rotor 22 can comprise a scroll rotor having a spiral scroll wrap or vane that cooperates with a complementary spiral wrap or vane of fixed scroll housing as described in U.S. Pat. No. 4,365,941, the teachings of which also are incorporated herein by reference.

In the design of such rotary fluid compressors, a small preselected design interference fit (e.g. 0.0015 to 0.003 inch)

is provided between the rotor 22 and the surface 32*a* of the stator 32 to provide a radial fluid (e.g. gas) sealing force F at the moving line contacts where the rotor 22 contacts the stator walls 32*a*, 32*b*. The design interference fit is illustrated in the FIGURE by centerline axis A4 of the rotor 22 being slightly offset relative to the crank pin centerline axis A2. For example, in assembling the crankshaft 12 in the compressor, the crankshaft cannot be assembled with its longitudinal axis A1 perfectly in line with the longitudinal axis A3 of the cylindrical stator surfaces 32*a*, 32*b* due to stack-up tolerances. As a result, there is an inherent rotor/stator housing bore eccentricity which causes the design interference fit to be greater than intended in one quadrant and less than intended in the opposite quadrant of motion of rotor 22. For example, when the crankshaft 12 is rotated by hand after assembly, there can be felt a "high" spot corresponding to the location of the greater than intended interference fit. As mentioned above, the relatively greater interference fit produces very high internal stresses on the rotor 22 and the other compressor components.

In accordance with an embodiment of the present invention, a preloaded spring mount 40 is provided to control the radial sealing force F between the rotor 22 and stator housing 32 in a manner that maintains the radial sealing force between a minimum preselected design radial force and a maximum preselected design radial force. In FIG. 1, the preloaded spring mount 40 is shown for purposes of illustration comprising spring means in the form of an annular spring 42 disposed about crank pin axis A2 and the bearing assembly 20 and radially compressed as shown between the bearing assembly 20 and the rotor 22. The spring 42 is shown including a central arcuate region 42*a* having a bowed or barrel-shaped configuration extending circumferentially about the spring to engage the rotor 22 in a circumferential region of contact and opposite, arcuate edges 42*b* extending circumferentially to engage the outer bearing race 20*b* in respective circumferential regions of contact. The bowed region 42*a* together with edges 42*b* provides mechanical spring action under radial load. The cross section of the spring 42 has a circular shape at any given plane taken perpendicular to the longitudinal axis of the spring. The outer race 20*b* can be provided with a greater wall thickness than those of outer races 14*b*, 15*b* in order to distribute the spring load.

The annular spring 42 is radially compressed (preloaded) to a preselected extent upon assembly of the compressor components so as to exert a controlled radial sealing force on the rotor 22, thereby providing, together with the design interference fit, a controlled fluid sealing force between the rotor 22 and the stator housing 32 when the rotor is in its normally deflected position on axis A3 relative to axis A2 of the crank pin. In particular, the spring 42 is preloaded in radial compression upon assembly between the bearing assembly 20 and the rotor 22 to provide, together with the design interference fit, a preselected minimum design radial sealing force between the rotor and stator housing. Moreover, the spring 42 is selected to exhibit a controlled spring rate under radial load that limits the radial sealing force between the rotor 22 and the stator housing 32 so as not to exceed a preselected maximum design radial sealing force when the spring 42 is deformed by the sum of the design interference fit between the rotor/housing and the maximum rotor/housing bore eccentricity resulting from assembly stack-up tolerances. That is, the spring 42 will deform at a controlled rate to maintain the radial sealing force so as not to exceed the maximum design sealing force. The spring 42 is provided with a configuration and thickness and is made of a suitable spring material, such as spring steel or other metal, to provide the above mechanical spring characteristics embodied in the practice of the invention. Moreover, the spring may include multiple axial slits or other apertures (not shown) to control the spring rate.

Although the annular spring 42 preferably comprises a one-piece annular spring, the spring means alternately may comprise multiple circular arc-shaped spring segments arranged to form a spring annulus to collectively control the radial sealing force between the rotor 22 and the stator housing 32 as described above.

The preloaded spring 42 prevents excessive stresses from developing in the rotor 22 and causing fatigue failure (fracture) of the rotor over time. The preloaded spring 42 also limits the compressor output pressure by providing controlled compressed fluid leakage (e.g. compressed gas leakage) at the rotor/stator housing line contacts by virtue of controlled spring compression when the compressor output pressure exceeds a preselected design limit. Still further, the generally circumferential lines of contact between the preloaded spring 42 and the rotor 22/crank pin 12 allow the rotor 22 to rock laterally as necessary to accommodate any misalignment between the axes A1, A2, and A3 that may be present as a result of the stack-up tolerances in assembly of the compressor components.

For purposes of illustration of the invention, the preloaded spring mount 40 is shown and has been described above as preferably being positioned between the bearing assembly 20 and the rotor 22. The invention is not so limited and can be practiced with the preloaded spring mount 40 positioned between the crank pin 12 and the bearing assembly 20 to achieve the above objects and advantages of the invention. In this event, the spring 42 is disposed about the crank pin 12, and the bearing assembly 20 would include an inner race circumferentially engaged by the spring 42.

Moreover, while the invention is described above in terms of specific embodiments, it is not intended to be limited thereto but rather only to the extent set forth in the following claims.

What is claimed:

1. Rotary fluid compressor, comprising a stator housing, a crankshaft rotatable about an axis of rotation and having a crank pin offset relative to said axis of rotation, a rotor disposed on said crank pin for orbiting motion about said axis of rotation, a bearing assembly including a plurality of rotatable bearing elements disposed between said crank pin and said rotor, and annular spring means disposed between said crank pin and said rotor in circumferential engagement with said bearing assembly, said spring means being compressed under radial load to provide together with interference fit between said rotor and said stator housing a controlled radial fluid sealing force between said rotor and said stator housing.

2. The apparatus of claim 1 wherein said spring means is pre-loaded and further compressed to provide at least a predetermined minimum radial fluid sealing force between said rotor and said stator housing.

3. The apparatus of claim 1 wherein said spring means exhibits a spring rate to limit said radial fluid sealing force so as not to exceed a maximum radial fluid sealing force between said rotor and said stator.

4. The apparatus of claim 1 wherein said spring means includes a bowed region extending about a circumference thereof.

5. The apparatus of claim 1 wherein said spring means is disposed between said bearing assembly and said rotor.

6. The apparatus of claim 1 wherein said spring means is disposed between said bearing assembly and said crank pin.

7. The apparatus of claim 1 wherein said rotor comprises a ring rotor.

8. A method of controlling a radial fluid sealing force between a stator housing and a rotor disposed by a bearing assembly on a crank pin of a crankshaft for orbiting motion about an axis of rotation of said crankshaft, comprising positioning annular spring means between said crank pin and said rotor in circumferential engagement with said bearing assembly, providing an interference fit between said rotor and said stator housing, and radially compressing said spring means to provide together with said interference fit a controlled radial fluid sealing force between said stator housing and said rotor.

9. The method of claim 8 including pre-loading and further compressing said spring means to provide at least a predetermined minimum radial fluid sealing force between said rotor and said stator housing.

10. The method of claim 8 wherein said spring means exhibits a spring rate to limit said radial fluid sealing force so as not to exceed a preselected maximum radial fluid sealing force between said stator and said rotor.

11. The apparatus of claim 1 wherein said rotor comprises a scroll rotor.

* * * * *